United States Patent [19]

Engelbert et al.

[11] 4,413,785

[45] Nov. 8, 1983

[54] VARIABLE PRESSURE FLUID CLEANING WAND

[75] Inventors: Carrol D. Engelbert, P.O. Box 1943, Walla Walla, Wash. 98362; Larry M. Muller, Nampa; Dan E. Muller, Melba, both of Id.

[73] Assignee: Carroll D. Engelbert, Walla Walla, Wash.

[21] Appl. No.: 302,226

[22] Filed: Sep. 14, 1981

[51] Int. Cl.[3] ..... B05B 9/00

[52] U.S. Cl. ..... 239/443; 239/530; 239/583

[58] Field of Search ..... 239/124, 443, 530, 532, 239/288, 583, 526, 447

[56] References Cited

U.S. PATENT DOCUMENTS

| | | | |
|---|---|---|---|
| 2,132,333 | 10/1938 | Wendell et al. | 239/530 X |
| 2,726,898 | 12/1955 | Henriksson | 299/144 |
| 2,820,676 | 1/1958 | Cleaves | 299/144 |
| 3,672,575 | 6/1972 | Hinrichs | 239/447 X |
| 3,765,607 | 11/1973 | Pacht | 239/124 X |
| 3,885,739 | 5/1975 | Tuttle | 239/124 X |
| 3,986,523 | 11/1976 | Pacht | 239/443 X |
| 3,987,963 | 11/1976 | Pacht | 239/124 X |

*Primary Examiner*—John J. Love
*Assistant Examiner*—Mary McCarthy
*Attorney, Agent, or Firm*—Dowrey & Cross

[57] ABSTRACT

A variable pressure wand or gun for connection to the flexible conduit of a pressure fluid cleaning system such as used in car washes and the like. Parallel high pressure and low pressure barrels are connected by a fluid passage having a normally open pressure fluid discharge valve plunger therein. A selectively hand operable grip and lever are provided for closing or seating the valve plunger against fluid pressure in the system, the degree of closing being proportional to the force applied to the grip. The high pressure barrel is equipped with a spray or jet nozzle and the flow of fluid to the low pressure barrel is controlled by the operation of the valve plunger.

8 Claims, 2 Drawing Figures

VARIABLE PRESSURE FLUID CLEANING WAND

BACKGROUND OF THE INVENTION

The present invention relates primarily to pressure fluid cleaning devices which are commonly known as pressure "guns" or "wands" used extensively in the car wash industry with fluid pressures up to approximately 2,000 psi as desired.

In the vehicle cleaning industry, and more particularly in the car wash industry, the trend has been toward increased use of self-service facilities wherein the customer, generally unfamiliar with cleaning equipment, is expected to operate the relatively high pressure fluid cleaning systems, i.e., water jets and the like. Prior art constant spray fluid pressure cleaning devices have the disadvantage of the danger involved in accidental dropping of the wand, known as "flying wand". The reaction force of the high pressure jet stream would result in driving the gun or wand out of control when released, causing damage to the car finish and/or user.

Prior art pressure fluid cleaning devices with on-off control have their own set of disadvantages, in that they have been relatively sophisticated or complicated devices. The expensive and complex valving and hand controlled apparatus provided were generally unsuitable for the unskilled user. Consequently, the possibility of damage and malfunction through misuse was always a concern. Other problems resulted from the rapid increase and decrease in head pressure on the pump system when the "on-off" unloader or regulator valve was operated. The result of "on-off" high pressure valve operation, of course, is rapid damage to cups and seals in the fluid pump system.

BRIEF DESCRIPTION OF THE INVENTION

The present invention provides an improved and structurally simplified pressure fluid cleaning wand which may be connected to standard flexible fluid pressure conduits such as used in car washes and other stationary or mobile cleaning systems. The wand has a high fluid pressure conduit and a low fluid pressure conduit. A by-pass valve between the two conduits includes a movable valve plunger and a valve seat. Selectively operable contact means can move the plunger into engagement with the valve seat, thereby preventing fluid flow from the high pressure to the low pressure conduit.

With the wand of the present invention, the fluid pressure of the cleaning jet may be varied from zero to approximately 2,000 psi, depending on the particular pump system, avoiding the undesirable "on-off" operation known to the prior art. The present simplified structure provides an immediate relief from the force of the high pressure jet in the event the wand is dropped or instantaneously released, avoiding the common problems associated with "flying wand." The structure of the wand and the variable pressure hand controlled valve is extremely simplified and inexpensive to manufacture since there need only be basically two moving parts. The structural arrangement of the hand operated valve control and grip or handle is such that inexperienced operators can immediately comprehend the hand action necessary to provide the variable high pressure jet stream. In addition, the hand grip of the wand provides almost effortless operation for an extended period of time, thus avoiding the fatigue normally experienced by amateur users. Also, the wand is streamlined and can be covered with plastic heat shrink tubing, thus eliminating sharp edges, and the damage and injury which such sharp edges can cause.

These and other objects of the invention will be understood from te following specification and claims in conjunction with the accompanying drawings.

DETAILED DESCRIPTION OF THE INVENTION

Although the present invention will be described with relation to a preferred embodiment suitable for the car wash industry, it will be understood that the variable pressure wand has universal application in other environments, and is not limited to vehicle cleaning.

Figure 2:
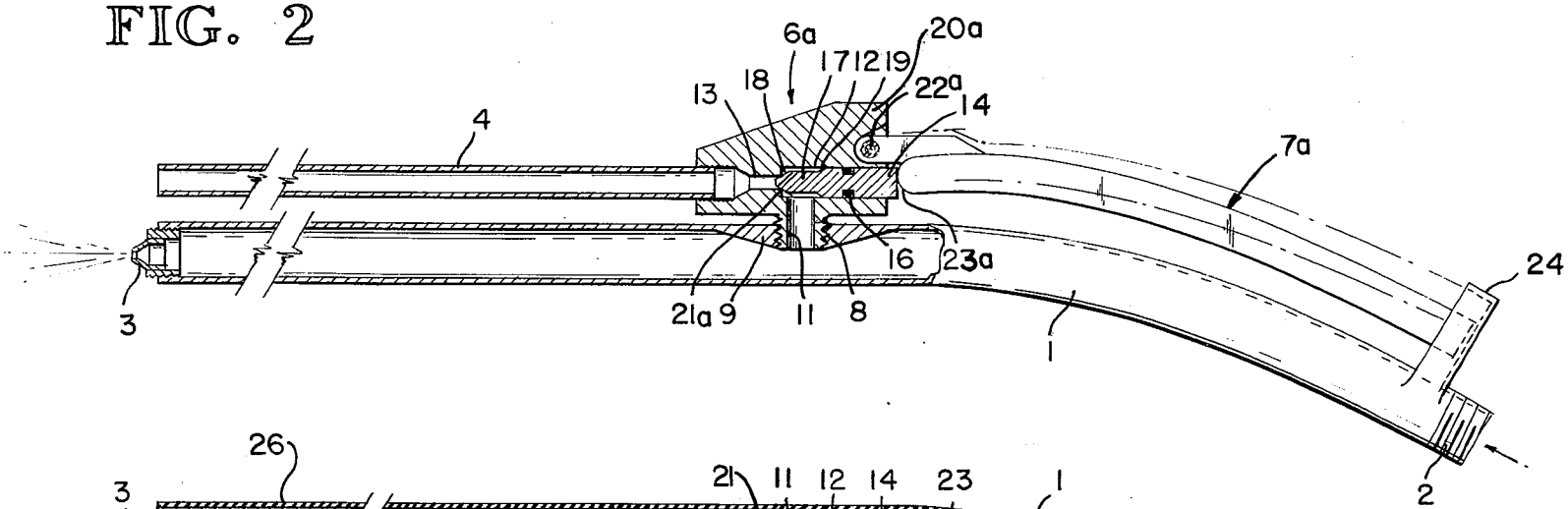
FIG. 2 is a partially sectioned longitudinal elevation showing an alternative embodiment.
Figure 1:
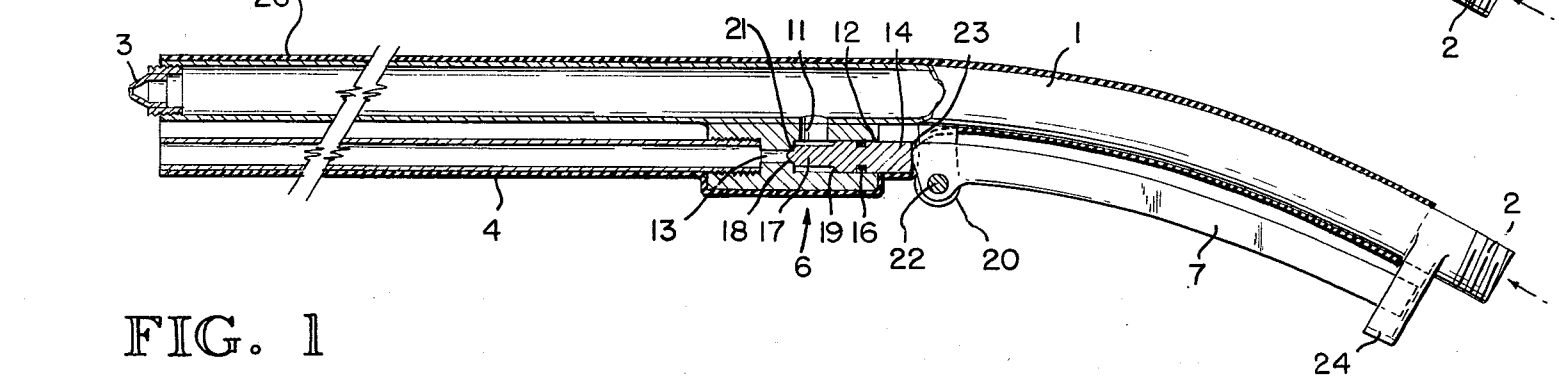
FIG. 1 is a partially sectioned longitudinal elevation showing the preferred embodiment of the wand including the pressure relief valve and hand grip valve operator.

With reference to both the FIGS. 1 and 2 embodiments, the wand is provided with a high fluid pressure conduit barrel 1. The high pressure barrel 1 may have suitable threads 2 or other means of connection to conduit means, usually a flexible hose or the like, connected to the pressure fluid source. Since the pressure fluid source and the associated conduit has no bearing on the present invention, no such system is illustrated in the drawing. There are many commercially available pump systems and conduit systems for providing the pressure fluid to the wand, and any such suitable system will suffice. The pressure range of such systems, as utilized in the car wash industry, is usually in the neighborhood of between 1,000 to 1,300 psi, with a maximum pressure of approximately 2,000 psi being commonly achieved.

The high pressure barrel 1 may be constructed of conventional black pipe, and for most uses a $\frac{3}{8}$ inch internal diameter will suffice. As mentioned, the high pressure barrel 1 is provided with means such as the thread 2 on the inlet end thereof for connection to the high pressure source. The opposite end of the barrel, or outlet end, will be provided with means for delivering a high pressure fluid stream, such as a jet nozzle 3, which may be screw-threaded into the end of the black pipe of the high pressure barrel 1 in a conventional manner. The jet nozzle 3 may also be any suitable, commercially available design which provides the desired jet or spray pattern necessary for the particular cleaning job involved.

Mounted beneath the high pressure barrel 1, when the wand of the preferred embodiment of FIG. 1 is held in position for normal operation, are the low fluid pressure conduit or discharge barrel 4, the valve housing 6 and the squeeze handle or hand grip 7. As shown in FIG. 2, the discharge barrel 4, valve housing **6*a* and hand grip 7*a* may alternatively be placed above the high pressure barrel 1. In either embodiment, the valve housing 6 or 6*a*** may comprise a unitary casting because of its structural simplicity and may be made from such materials as stainless steel or nylon or any other suitable material.

In the preferred embodiment, the valve housing 6 is welded to the barrel 1 as shown in FIG. 1. Alternatively, the valve housing **6*a* may include, as shown in FIG. 2, a screw-threaded nipple or extension 8 on its bottom side which is threadedly engaged in the wall of the barrel 1 and is in fluid sealing engagement therewith. In such an embodiment, the internal wall of the pipe 1 may be provided with such material as a brass fill 9 which is tapped to receive the screw-threaded portion of the extension 8**.

In either embodiment, the valve body 6 or 6*a* is provided with an internal fluid passage bore 11 which communicates with the high pressure barrel 1 and with the longitudinal through bore 12 at right angles thereto. The bore 12 is provided with a reduced diameter portion 13 for a purpose presently to be described. The bore 12 is connected to the inlet end of the low pressure or discharge barrel 4, and is preferably in axial alignment with the discharge barrel 4. The discharge barrel 4 extends parallel to the high pressure barrel 1, and may be connected to the valve body 6 or 6*a* in any conventional manner such as screw-threading or the like as illustrated for easy removal and replacement.

Extending axially within the bore 12 is the valve plunger 14 which is designed to freely reciprocate within the bore 12. The O-ring seal 16 upstream from the fluid passage bore 11 provides a fluid pressure seal between the bore and the valve plunger. The upstream end of the valve plunger 14 extends externally of the valve body 6 or 6*a*. At the downstream end, the valve plunger 14 is provided with a reduced diameter end portion 17 to allow pressure fluid to circulate thereabout and is formed with the pressure reactive surfaces 18 and 19 which are subjected to the high pressure in the lower barrel 1 by means of the passage 11. With reference to FIG. 1, the pressure fluid within the barrel 1 constantly exerts an unseating force on the valve plunger to unseat the valve element from the seat 21, providing a low pressure discharge for the system. To minimize wear, the valve seat 21 will preferably have an angle of less than 60°, with a 45° angle being the most preferred. With reference to FIG. 2, the pressure surface 18 provides a conical surface which comprises a valve element for seating against the annular edge 21*a* provided by the reduced diameter portion 13 of the bore 12. In either embodiment, when the pressure surface 18 is in full contact with the valve seat 21 or 21*a*, a seal is thus created between the valve plunger 14 and the walls of the bore 12.

The hand grip 7 or 7*a* comprises an elongated member, preferably extending parallel to the high pressure barrel 1, in a direction away from the plunger 14 and pivoted at one end by means of the pivot pin 22 or 22*a*. The preferred pivot bracket 20, mounted on the bottom of the high pressure barrel 1, is shown in FIG. 1. By mounting the pivot bracket 20 at a right angle to the high pressure barrel 1 and placing the pivot point 22 close to the axis of the valve plunger 14, the greatest leverage is achieved. An alternative pivot bracket 20*a* is shown in FIG. 2.

It will be appreciated, of course, that the hand grip pivot arrangement shown in FIG. 1 could be utilized for a top mounted grip by attaching an upstanding pivot bracket on the top side of the barrel 1. In the alternative, a U-shaped bracket extending around and under the high pressure barrel to hold the hand grip at a pivot point close to the axis of the valve plunger would accomplish the same purpose.

In both FIGS. 1 and 2, the hand grip 7 or 7*a* is in the valve-closed position. In this position, the pressure fluid in the high pressure barrel 1 is prevented from discharging through the pipe 4 past the valve plunger 14 and is forced through the nozzle 3 providing the cleaning jet or spray. The grip 7 is, of course, pivoted toward the high pressure barrel and then held in this position by hand pressure of the operator who grips both the barrel 1 and handle 7. In this position, the conical surface 18 of valve plunger 14 is forced into seating and sealing engagement with the valve seat 21. The end 23 of the freely pivotable hand grip 7 contacts the plunger 14 to move it to the desired position, and holds it in that position, against the force of the pressure fluid in the bore 12. In a like manner, the end 23*a* of the grip 7*a* holds the plunger in the desired position.

It will be understood that the pressure of the fluid exiting the high pressure barrel 1 through the nozzle 3 may be selectively varied by the operator simply by varying the pressure of his grip on the handle 7 or 7*a*. When the hand grip moves away from the high pressure barrel 1, the contact end 23 or 23*a* moves away from the external end of plunger 14, and the valve plunger 14 can then move to the right, thereby discharging some of the high pressure fluid in the barrel 1 through the bores 11 and 12 of the valve housing and the discharge barrel 4. The outward movement of the hand grip 7 or 7*a* is limited by the guard 24.

Since sudden total pressure drop or high pressure cut-off is undesirable, the valve plunger 14 should preferably have a limited range of motion away from its closed position, so that a minimum fluid pressure can be maintained in the barrels 1 and 4. In a preferred embodiment, with a reduced diameter portion 17 having an outer diameter of $\frac{1}{4}$ and a bore 12 having an inner diameter of 5/16 inch, the plunger 14 should be able to move a maximum of 0.04 inches in a lateral direction away from the closed position. In a typical system with water pressure of about 1000 to 1300 psi and a 3 to 5 gallons per minute flow rate, this will provide about 200 psi of pressure exiting from both barrels 1 and 4 when the valve plunger 14 is in its maximum open position. These dimensions can be varied to provide any preselected minimum pressure desired.

To achieve this 0.04 inch range of plunger movement, in the embodiment of FIG. 1, the clearance between the valve plunger 14 in its closed position and the hand grip end 23 when the hand grip 7 is pivoted to its maximum distance from the high pressure barrel 1 should be 0.04 inch.

In the preferred embodiment, the wand will have a substantially streamlined design. As is evident in FIG. 1, the high pressure barrel 1 and low pressure barrel 4 will be parallel and in close proximity. The high pressure barrel 1 will have a curved portion near the inlet end, and the hand grip 7 will extend close to the adjacent high pressure barrel 1, with a conforming curvature. This curved portion can be used as an easily gripped handle. The entire assembly from the outlet ends of the barrels 1 and 4 at least to the valve body 6, and preferably to the inlet end of the high pressure barrel 1, will be covered by heat shrink tubing 26, such as that sold by Sigmaform Corporation, Santa Clara, Calif., under the product code BSTS-15. This gives the wand aesthetic appeal, and also eliminates the problems caused by sharp edges catching on other washing equipment, or causing damage to a car finish or injury to a user. For car wash use, the desirable outer dimensions for the streamlined valve housing 6 and discharge barrel 4 are a height of about $\frac{3}{4}$ inch for the valve housing, and an outer diameter of about $\frac{5}{8}$ inch for the discharge barrel 4. These dimensions can, of course, be varied as desired.

With this structural arrangement, it will be appreciated by those skilled in the art that, with direct contact between the valve plunger 14, the end of the hand grip 7 or 7*a* and the valve seat 21 or 21*a*, a much simplified valve housing 6 or 6*a* may be provided. Also, with the present simplified structure, release of the hand grip 7 or 7*a* immediately results in eliminating the reactive force of the high pressure water jet since the valve plunger immediately moves to the right under influence of the pressure fluid. It will be appreciated by those familiar with the art, of course, that movement of the valve plunger to the open position may be assisted by spring pressure if desired. Such modification of the structure described is considered to be within the scope of the invention. As aforementioned, the safety features of the present structural arrangement adapt the present invention for use by unskilled personnel and do-it-yourself car wash operations. Those skilled in the art will also appreciate the elimination of the need for maintenance made possible by the simplified valving and barrel arrangement. As many possible embodiments may be made of the invention without departing from the scope thereof, it is to be understood that all matter herein set forth or shown in the accompanying drawings is to be interpreted as illustrative and not in a limiting sense.

What is claimed is:

1. A wand for delivery of pressure fluid comprising in combination:

high fluid pressure conduit means for connection to a pressure fluid source, low fluid pressure conduit means, bypass valve means acting between said high and low fluid pressure conduit means, said valve means including valve seating means and movable plunger means for engaging said valve seating means to prevent fluid flow from said high fluid pressure conduit means to said low fluid pressure conduit means, and selectively operable contact means for moving said plunger into engagement with said valve seating means, comprising an elongated member extending substantially parallel to said high fluid pressure conduit means, said contact means and said high fluid pressure conduit means being constructed and arranged to be gripped by the user's hand and selectively moved together to move the plunger into seating engagement, said contact means being mounted for pivotal movement toward and away from said high fluid pressure conduit means and operable for moving said plunger into seating arrangement by pivotal movement thereof toward said high fluid pressure conduit means.

2. The wand of claim 1, wherein the sealing engagement between said valve seating means and said plunger is variable by hand pressure to vary the fluid pressure in said high fluid pressure conduit.

3. The wand of claim 1 wherein said low fluid pressure conduit, said valve means and said contact means are mounted beneath said high fluid pressure conduit during normal operation.

4. A wand for delivery of pressure fluid according to claim 1 wherein said plunger means includes surface means on said plunger means subject to said high fluid pressure acting in a direction away from engagement with said valve seating means.

5. A wand for delivery of pressure fluid comprising:

first high pressure conduit means adapted to be connected at an inlet end to a pressure fluid source, having an outlet end with means for delivering a high pressure fluid stream, and having a curved end portion adjacent its inlet end, second low pressure conduit means arranged in parallel flow relation with said first conduit means, said high and low pressure conduit means being in close proximity, valve body means having a longitudinal through bore in axial alignment with and connected to an inlet end of said second conduit means, fluid passage means in said valve body connecting said bore and said first conduit means and extending at right angles thereto, a valve plunger extending axially in said bore and mounted for reciprocating movement therein, first seal means acting between said valve plunger and said bore upstream from said fluid passage means, said plunger extending externally of said valve body and being movable between a first open position to permit flow of pressure fluid from said fluid passage means through said bore and into said second conduit means and a second closed position wherein the end of said valve plunger is located downstream of said fluid passage means, second seal means acting between said valve plunger and the walls of said bore downstream from said fluid passage means when the end of said plunger is located downstream of said fluid passage in said second position, and selectively operable contact means operatively associated with said first conduit means and said valve body and pivotally mounted for movement toward and away from said first conduit means, said contact means including a handle portion extending close to, adjacent and in conforming curvature with said high pressure conduit means, said high pressure conduit means and said handle portion comprising an operating hand grip for said wand and being arranged to contact the external end of said valve plunger when moved toward said first conduit means for moving said valve plunger toward said second position and permitting return of said valve plunger toward said first position when released.

6. The wand of claim 5 further comprising heat shrink plastic tubing covering the wand at least from said valve body to the outlet ends of said first and second conduits.

7. A wand for delivery of pressure fluid comprising:

a high pressure barrel having means on the inlet end thereof for connection to a pressure fluid source and a pressure fluid stream forming means on the outlet end thereof, a valve body mounted on said high fluid pressure barrel below said barrel, and having a through bore extending parallel to said high fluid pressure barrel and a fluid passage extending at right angles therebetween, a low fluid pressure barrel extending parallel with and below said high fluid pressure barrel and connected to the outlet end of said bore, a valve seat formed in said bore downstream from said fluid passage, a valve plunger located for reciprocation in said bore and adapted to engage said valve seat to prevent fluid flow between said barrels, said plunger extending externally of said valve body, seal means acting between said valve plunger and said bore upstream of said fluid passage, and plunger operating means for contacting the external end of said plunger to move the plunger to seating engagement with said valve seat, said plunger operating means being pivotally mounted to said valve body and extending along said high fluid pressure barrel, below said high fluid pressure barrel, whereby said plunger operating means and said high fluid pressure barrel may be hand gripped to move the plunger into seating engagement to operate said wand.

8. A wand for delivery of pressure fluid comprising:

first high pressure conduit means adapted to be connected at an inlet end to a pressure fluid source and having an outlet end with means for delivering a high pressure fluid stream, said inlet end being lower than said outlet end during normal operation;

second low pressure conduit means arranged in parallel flow relation with and mounted beneath said first conduit means, during normal operation;

valve body means mounted beneath said first conduit means during normal operation and having a longitudinal through bore in axial alignment with and connected to an inlet end of said second conduit means;

fluid passage means in said valve body connecting said bore and said first conduit means and extending at right angles thereto;

a unitary valve plunger extendng axially in said bore and mounted for reciprocating movement therein;

first seal means acting between said valve plunger and said bore upstream from said fluid passage means;

said plunger extending externally of said valve body and being movable between a first open position to permit flow of pressure fluid from said fluid passage means through said bore and into said second conduit means and a second closed position wherein the end of said valve plunger is located downstream of said fluid passage means, said plunger means including means for forcing said plunger means away from said second closed position;

second seal means acting between said valve plunger and the walls of said bore downstream from said fluid passage means when the end of said plunger is located downstream of said fluid passage in said second position;

bracket means connected to the bottom side of said first conduit means during normal operation;

selectively operable contact means operatively associted with said first conduit means and said valve body and pivotally mounted beneath said first conduit means during normal operation for movement toward and away from said first conduit means, said contact means including an elongated handle portion extending parallel to said first conduit means in a direction away from said valve plunger, and being arranged to contact the external end of said valve plunger when moved toward said first conduit means for moving said valve plunger toward said second position and permitting return of said valve plunger toward said first position when released; and pivot means connecting said contact means to said bracket.

* * * * *